US005161684A

United States Patent [19]

Stabenow

[11] Patent Number: 5,161,684

[45] Date of Patent: Nov. 10, 1992

[54] RETAIL PACKAGING FOR SEWING THREADS AND METHOD OF MAKING SAME

[75] Inventor: Michael Stabenow, Gutach, Fed. Rep. of Germany

[73] Assignee: Gutermann & Co. AG, Zurich, Switzerland

[21] Appl. No.: 766,734

[22] Filed: Sep. 27, 1991

[51] Int. Cl.[5] ..... B65D 85/00

[52] U.S. Cl. ..... 206/388; 66/202

[58] Field of Search ..... 206/49, 388, 389, 410, 206/417; 66/202, 1.5, 147, 167, 195; 2/1, 90, 158, 170, 243 A, 243 R

[56] References Cited

U.S. PATENT DOCUMENTS

| | | | |
|---|---|---|---|
| 1,457,625 | 6/1923 | Freydberg | 206/389 |
| 1,612,553 | 12/1926 | Hook | 206/388 |
| 1,613,431 | 1/1927 | Barbour | 206/388 |
| 2,117,997 | 5/1938 | Taylor | 206/388 |
| 2,436,402 | 2/1948 | Potter | 206/388 |
| 3,102,322 | 9/1963 | Whitaker | 66/202 |
| 3,331,221 | 7/1967 | Lawson, Jr. | 66/202 |
| 3,827,261 | 8/1974 | Rupprecht | 66/202 |
| 5,050,406 | 9/1991 | Strass | 66/202 |

FOREIGN PATENT DOCUMENTS

| | | | |
|---|---|---|---|
| 0335860 | 10/1930 | United Kingdom | 206/388 |

*Primary Examiner*—Jimmy G. Foster
*Attorney, Agent, or Firm*—Baker, Maxham, Jester & Meador

[57] ABSTRACT

This invention concerns a spool of thread which has no disposable residue. More specifically, the spool is formed of a cylinder of a knitted web of the thread which is easily unraveled as the thread is used and fed from one end. The method of making the package comprises forming a generally flat knitted web into a compact, generally cylindrical body comprising only the thread. This package is then labelled and shipped for eventual use. This product is particularly useful in that there is no residue. When the thread is used up, so is the package.

7 Claims, 1 Drawing Sheet

RETAIL PACKAGING FOR SEWING THREADS AND METHOD OF MAKING SAME

FIELD OF THE INVENTION

This invention relates generally to packaging and dispensing means for sewing threads and more particularly concerns a package made entirely of thread, which package disappears when the thread is used up.

BACKGROUND OF THE INVENTION

Present retail packaging for threads comprises a cylinder or cone, typically made of paper, wood or plastic, on which is wound the thread in a spiral, overlapping manner. For feeding or using the thread, it is either pulled in a tangential direction with the spool mounted for easy rotation or it is pulled off in an axial direction with the spool stationary. In both instances, the thread is essentially unwrapped from its spiral condition. In either case, the cylinder or cone, sometimes referred to as bobbins, are left and must be disposed of when the thread is used up.

SUMMARY OF THE INVENTION

Broadly speaking, this invention concerns a spool of thread which has no disposable residue. More specifically, the spool is formed of a body such as a cylinder of a knitted web of the thread which is easily unraveled as the thread is used and fed from one end. The method of making the package comprises making a generally flat knitted web and forming it into a compact, generally cylindrical body comprising only the thread. This package is then labelled and shipped for eventual use. This product is particularly useful in that there is no residue. When the thread is used up, so is the package.

BRIEF DESCRIPTION OF THE DRAWING

The objects, advantages and features of this invention will become more readily apparent from the following detailed description, when read in conjunction with the accompanying drawing, in which.

DESCRIPTION OF THE PREFERRED EMBODIMENT

Figure 1:
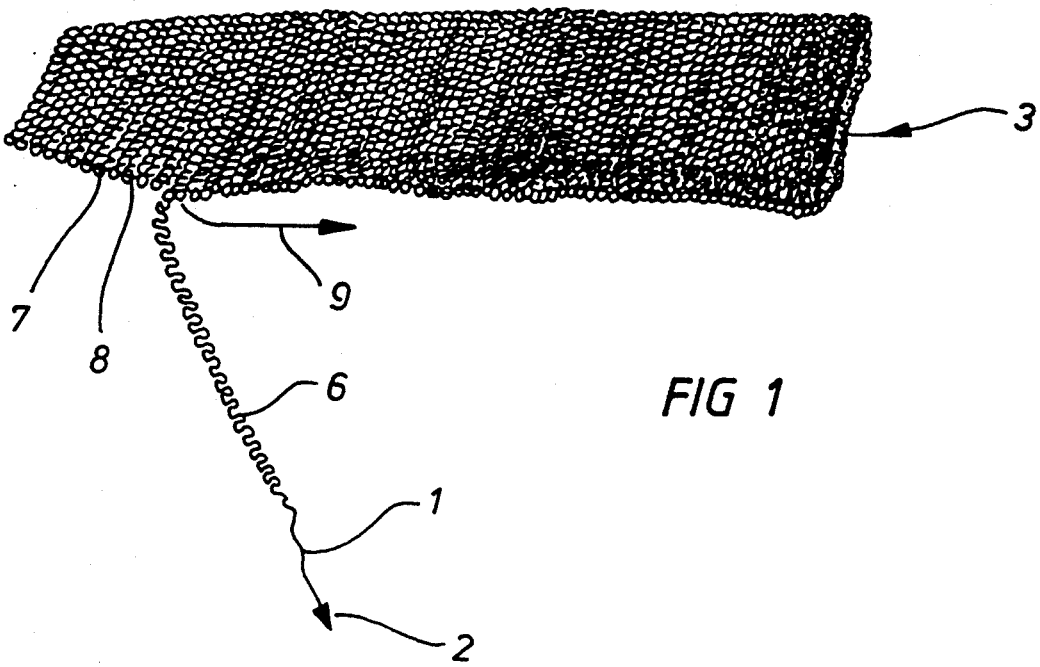
FIG. 1 shows a portion of a flat knitted web.

With reference now to the drawing, and more particularly to FIG. 1, there is shown a knitted web 7 comprised entirely of a single strand or element of thread 1. As with any knitted fabric, if one end of the thread starts to unravel, constantly pulling that end results in complete disappearance of that item which was knitted. In this instance, arrow 2 represents the direction of pull of the thread whereas numeral 6 indicates the crimped or zig-zagged condition of the thread as it is immediately pulled off the web. As thread 1 is pulled, the point of connection with web 7 moves in the direction of arrow 9 and this continues back and forth across edge 8 of the web.

Figure 2:
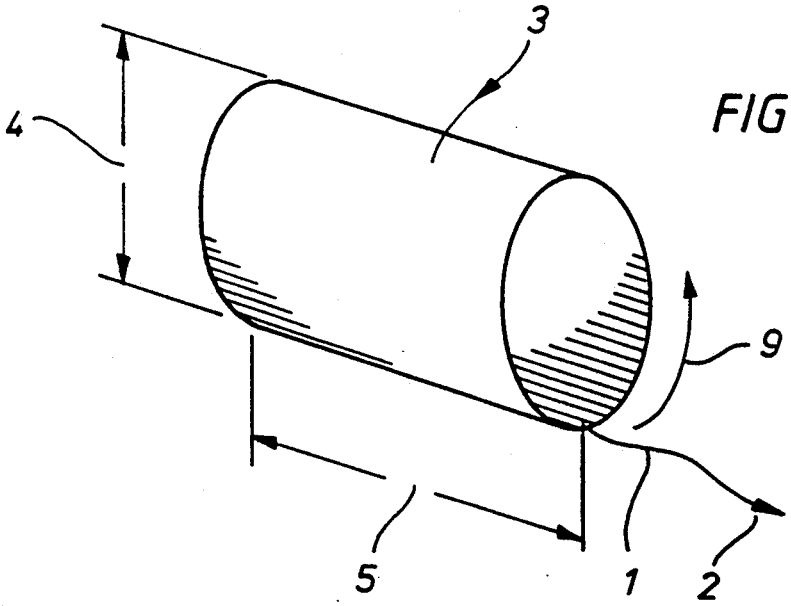
FIG. 2 is a perspective view of the web of FIG. 1 formed into a tube.

FIG. 2 shows the web of FIG. 1 formed into a cylinder. It should be noted that web 7 may be formed into any desired shape, but cylindrical is readily usable in many instances and is the more likely configuration. Web 7 may be tightly rolled into a compact body or otherwise formed into the cylinder with an axial bore. If formed with end 3 along the longitudinal surface of the cylinder as shown, thread 1, when pulled in the direction of arrow 2, would feed from the end adjacent to arrow 9 in FIG. 2 and would keep spiraling from that end as the cylinder grows shorter and shorter. In this embodiment, diamater 4 would remain the same while length 5 of the cylinder would change as the thread is fed therefrom.

Alternatively, the cylinder shown in FIG. 2 could be wound with edge 8 of FIG. 1 along the length of the cylinder and end 3 being at the circular end of the cylinder so that the thread would feed back and forth linearly along the outside edge from end to end. In that configuration, diameter 4 would be reducing while length 5 would stay the same until the thread is used up.

A major feature of this invention is the fact that the thread constitutes the entire package for shipping and dispensing of the thread. There is no residue, bobbin, cone or cylinder left for disposal. Once the thread is gone, the package has in effect disappeared or become nonexistent.

In view of the above description, it is likely that modifications and improvements will occur to those skilled in the art which are in the scope of the accompanying claims.

What is claimed is:

1. A method for forming a retail package for sewing threads comprising the steps of:

forming a flat, generally rectangular, knitted web of unitary thread;

forming the flat web into a bobbinless tube-shaped configuration of only the thread web; and leaving an end of the unitary thread extending from the tube, which end may be pulled to continuously feed and unravel the thread until the thread is gone and the tube is nonexistent.

2. The method recited in claim 1, wherein the tube is configured from the flat web so that the unitary thread extending end is pulled off the circular end of the tube, thereby reducing the length of the tube as the thread is payed out.

3. The method recited in claim 1, wherein the tube is configured from the flat web so that the unitary thread extending end is pulled off the side along the length thereof so that the diameter of the tube reduces as the thread is payed out.

4. A method for forming a retail package for sewing threads comprising the steps of:

forming a flat, generally rectangular, knitted web of unitary thread;

forming the flat web into a bobbinless, three-dimensional compact body configured only of the thread web; and leaving an end of the unitary thread extending from the body, which end may be pulled to continuously feed and unravel the thread until the thread is gone and the body is nonexistent.

5. A retail package for sewing threads comprising:

a generally flat, rectangular knitted web of unitary thread formed into a bobbinless, generally tubular, body configured only of the thread web; and an end of said unitary thread extending from said body to enable said thread to be pulled therefrom in a continuous manner until said thread is used up and said body is nonexistent.

6. The sewing thread package recited in claim 5, wherein said thread end extends from the circular end of said tube so that when the thread is payed out the length of said tube reduces.

7. The sewing thread package recited in claim 5, wherein said thread end extends from the longitudinal side of said tube along the length thereof so that the diameter of the tube reduces as the thread is payed out.

* * * * *